US005388691A

United States Patent [19]

White

[11] Patent Number: 5,388,691

[45] Date of Patent: Feb. 14, 1995

[54] PROTECTIVE CASE FOR REMOTE CONTROL TRANSMITTER

[76] Inventor: Nona J. White, 1141 NW. 84th Ter., Pembroke Pines, Fla. 33024

[21] Appl. No.: 139,567

[22] Filed: Oct. 21, 1993

[51] Int. Cl.[6] ..... B65D 85/38; A45C 11/32; G08C 19/00

[52] U.S. Cl. ..... 206/305; 70/456 R; 206/37; 206/38; 220/242; 220/346; 220/351; 340/825.69; 340/825.71

[58] Field of Search ..... 206/305, 320, 38, 37, 206/38.1, 39, 37.1; 150/165; 220/241, 242, 345, 346, 350, 351; 340/825.31, 825.32, 825.34, 825.69; 70/456 R

[56] References Cited

U.S. PATENT DOCUMENTS

| | | | |
|---|---|---|---|
| D. 315,112 | 3/1991 | Andrew et al. . | |
| 3,021,142 | 2/1962 | Carroll . | |
| 3,127,653 | 4/1964 | Budreck | 335/285 |
| 3,362,564 | 1/1968 | Mueller | 220/346 |
| 3,406,821 | 10/1968 | Weissberg | 220/345 X |
| 3,527,373 | 9/1970 | Giraudet et al. | 220/345 |
| 3,632,848 | 1/1972 | Young et al. . | |
| 3,819,921 | 6/1974 | Kilby et al. . | |
| 4,116,706 | 9/1978 | Previte . | |
| 4,165,554 | 8/1979 | Faget | 206/305 X |
| 4,208,720 | 6/1980 | Harrison . | |
| 4,231,626 | 11/1980 | Amtmann et al. . | |
| 4,259,568 | 3/1981 | Dynesen . | |
| 4,281,527 | 8/1981 | Leopoldi et al. | 70/456 R |
| 4,348,723 | 9/1982 | Woods et al. . | |
| 4,402,423 | 9/1983 | Skowronski et al. | 220/345 |
| 4,412,356 | 10/1983 | Klaus et al. | 340/825.71 X |
| 4,420,078 | 12/1983 | Belt et al. . | |
| 4,478,330 | 10/1984 | Lin . | |
| 4,713,951 | 12/1987 | Ros | 70/456 R |
| 4,733,776 | 3/1988 | Ward | 206/305 |
| 4,836,256 | 6/1989 | Meliconi | 206/305 X |
| 4,890,108 | 12/1989 | Drori et al. | 340/825.69 X |
| 4,951,817 | 8/1990 | Barletta et al. . | |
| 5,220,319 | 6/1993 | Kendel | 340/825.69 |
| 5,263,577 | 11/1993 | Paratte et al. | 206/38.1 |
| 5,265,720 | 11/1993 | Meliconi | 206/305 |
| 5,278,556 | 1/1994 | Oh | 340/825.69 X |

OTHER PUBLICATIONS

Motorola Technical Developments "Pager and Garage Door Opener Combination" Mar. 1990.

The Clifford DeltaIII TM an advanced technology remote control vehicle security system.

*Primary Examiner*—Bryon P. Gehman

[57] ABSTRACT

A case protecting the buttons of and supporting a remote control transmitter, the transmitter including an opening to receive a key chain ring, the case further including a container and a rigid clear plastic cover-panel that is slidable by one's thumb. The cover-panel is fitted within two side grooves tapered only at rear ends in the container and also includes a catch that prevents the cover-panel from sliding completely off the container in a forward direction. The container includes an indentation notch on one side end wall that allows the catch to pass therethrough when sliding the cover-panel completely off the container in the rearward direction. There is also provided a second opening in the container that permits the transmitter's key chain ring opening to pass therethrough. The case protects the buttons of the transmitter. The transmitter can be one that activates personal or auto alarms, opens and closes garage doors or gates, unlocks an automobile trunk, or controls household electronics.

17 Claims, 4 Drawing Sheets

PROTECTIVE CASE FOR REMOTE CONTROL TRANSMITTER

The invention relates to a case with sliding panel-cover for protecting control-buttons and switches on a remote control transmitter from being activated, and in particular protecting against accidental activation of the control button on a car alarm's remote control transmitter.

BACKGROUND AND PRIOR ART

Protective cases for remote control transmitters are well known to made from flexible material such as leather and vinyl. Remote control transmitters are well known for having buttons and/or switches that control car alarms, personal alarms, garage door openers, automobile trunk releases and various household electronics such as a television.

As an example, U.S. Pat. No. 4,951,817 shows a receptacle case 18 FIG. 1 formed out of protective material, such as leather, vinyl, or cloth which is used for protecting electronic beeper buttons.

Protective covers have also been used for other hand-held devices such as calculators. As an example, U.S. Pat. No. 4,165,554 discloses an assembly comprising a calculator with buttons on one side a sliding cover which can be attached either to the front or the back. However, there is no separate container for this cover and the cover itself is not clear. Further, there are no modifications for using this cover with a remote control transmitter.

No protective case with a clear slidable cover-panel is known which is especially directed toward protecting the control-button or switch era remote control transmitter from being activated accidentally. Accidental activation of a control button and/or switch can take place when the remote transmitter is inserted within a handbag or pocket, held tightly in ones hand or dropped.

It is accordingly an object of the instant invention to provide a protective case with slidable cover which prevents the accidental activation of a remote control transmitter.

SUMMARY OF THE INVENTION

The basic idea of the protective case is to prevent the accidental activation of control-buttons or switches on remote transmitters.

According to the invention there is provided a protective case comprising a container formed by plastic or metal, and a clear slidable plastic cover-panel that is slidable by one's thumb. The cover-panel is slidable on the container by sliding within tapered grooves formed in the container. The grooves are tapered such that the cover-panel can stay in a closed position on the container.

According to a further feature, the cover-panel also includes a catch means for preventing the cover-panel from sliding off the container in a forward direction.

According to a further feature, the container also includes an indentation-notch on one side wall for allowing the catch means to pass through when sliding the cover-panel in a backward direction completely off the container.

According to a further feature, there is also provided a second opening in the container for connecting a key chain ring therethrough.

According to a further feature, the container can be configured to fit the remote transmitter and/or can include optional foam type rubber inserts liar filling space between the container and the transmitter to create a snug fit between the container and the transmitter.

A preferred embodiment of using the invention is for preventing the accidental disarming of an automobile alarm after the alarm has been activated. The protective case would have further beneficial application for protecting remote transmitters which control personal alarms, garage door openers, gate openers, automobile trunk releases and various household electronics such as a television.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of file present invention in detail it is to be understood that the invention is not limited in its application to the details of the particular arrangement shown since the invention is capable of other embodiments. Also, the terminology used herein is for the purpose of description and not of limitation.

Figure 1:
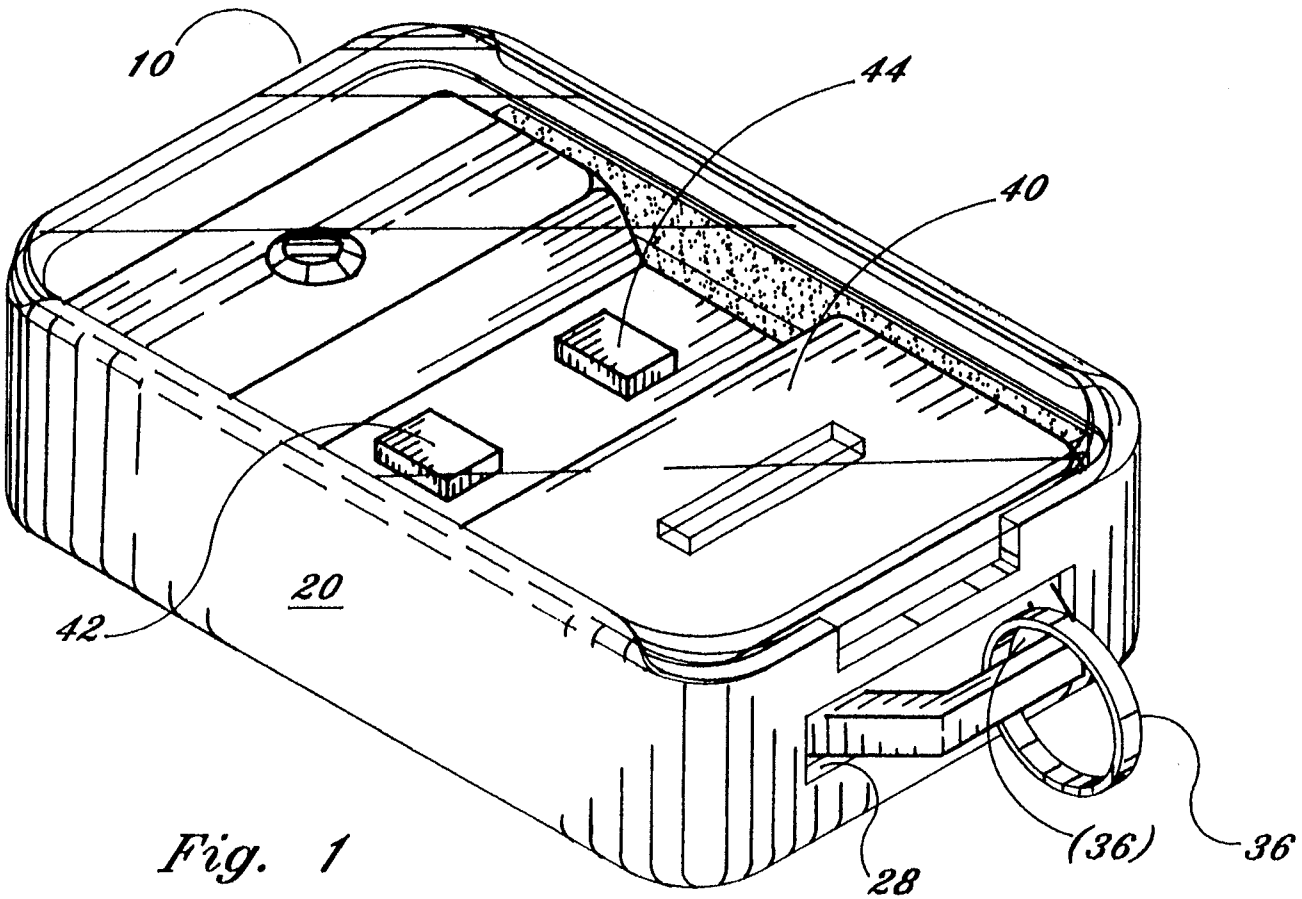
FIG. 1 is a perspective view of the invention showing the container and the slidable cover-panel in a closed position with a remote transmitter within the container.

An embodiment of the invention and method for operation is illustrated in FIGS. 1 through 6. FIG. 1 is a perspective view of the invention showing the container 20 and the slidable cover-panel 10 in a closed position with a remote transmitter 40 within the container, and key chain ring 36 extending from container 20. The remote control transmitter 40 can include control-button(s) and/or switches 42, 44 for activating personal and auto alarms, opening and closing garage doors and gates, a release for an automobile trunk, controlling household electronics such as a television, and the like.

Figure 2:
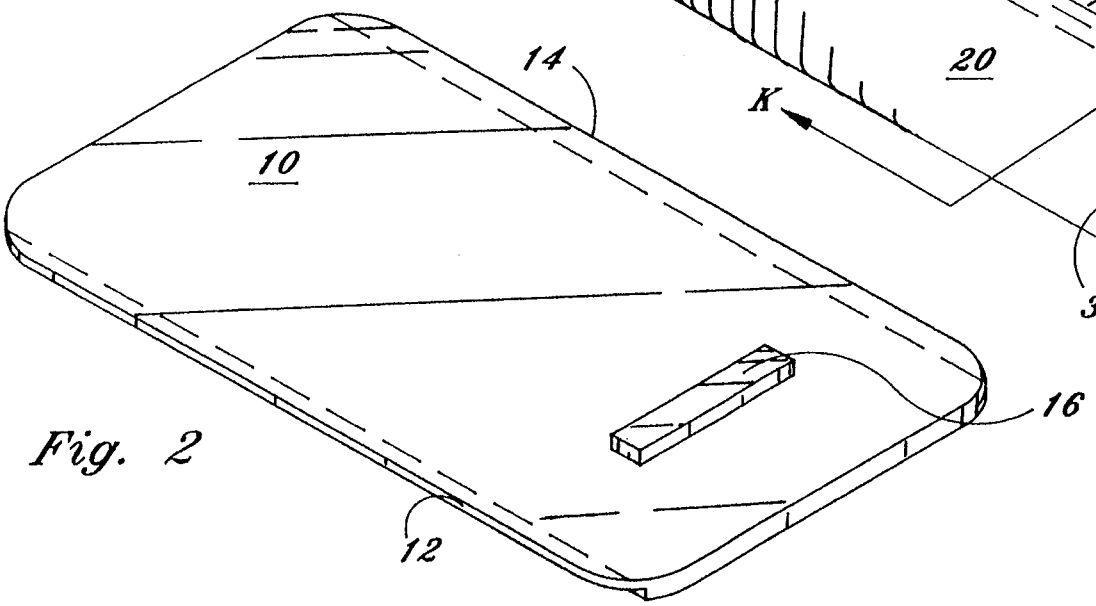
FIG. 2 is a view of the rear side of cover-panel of FIG. 1.
Figure 6B:
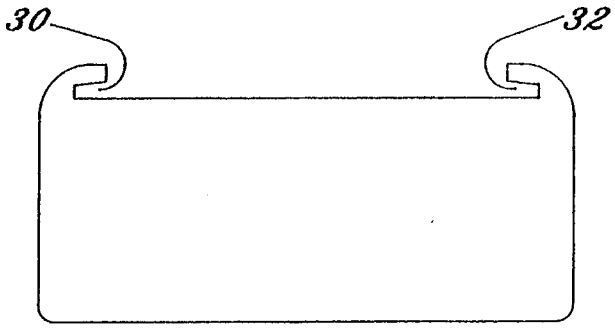
FIG. 6 is a perspective view of the invention showing the slidable cover-panel on the container in an open position with a remote transmitter within the container.
Figure 6C:
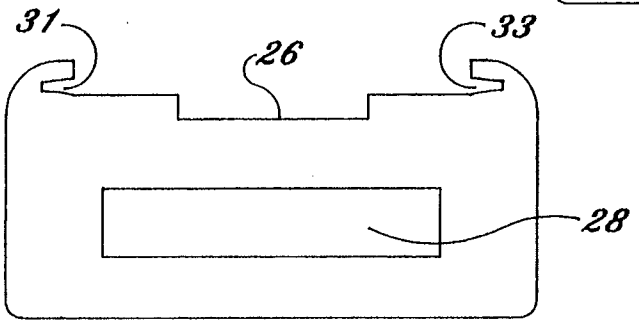

FIG. 2 is a view of the rear side of cover-panel 10 of FIG. 1, with a catch 16 extending from the rear side. Cover-panel 10 is romped frown a plastic material or the like and is to be clear therethrough. The clear plastic cover-panel lets one see through to the remote transmitter and would be strong enough to prevent the control-buttons or switches from being accidentally activated. Thinner side edges 12, 14 are formed on cover-panel 10.

Figure 3:
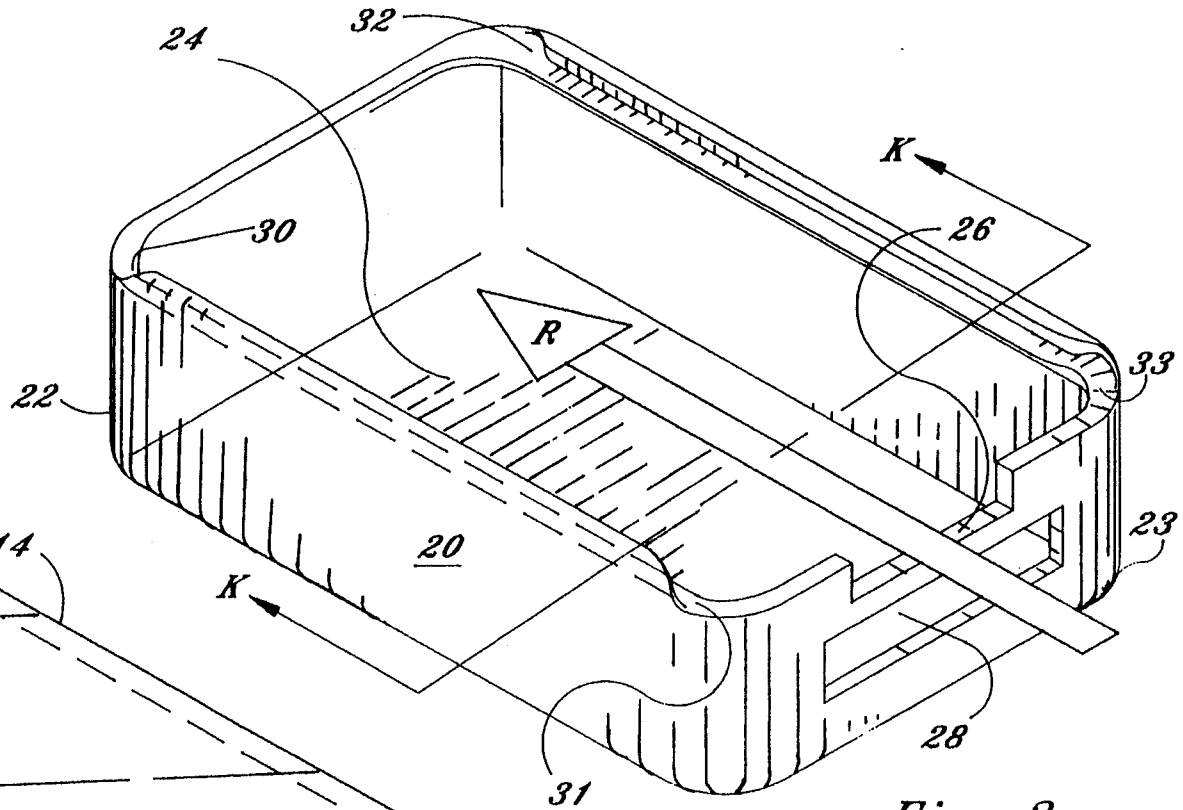
FIG. 3 is a perspective view of the protective container of FIG. 1.

FIG. 3 is a perspective view of the protective container 20 of FIG. 1 to be formed of textured plastic material, metal or the like. Curved or bevelled edges 22, 23 make the container attractive, comfortable to handle and less likely to show through or puncture clothing. Grooves 30–33 are shown on opposite sides of the longitudinal inner walls of the container 20. The grooves taper near one end 31, 33. Container 20 has a first opening 24 for receiving a remote transmitter, second opening 28 for allowing key chain ring 36 to pass therethrough, and an indentured notch 26.

Figure 4:
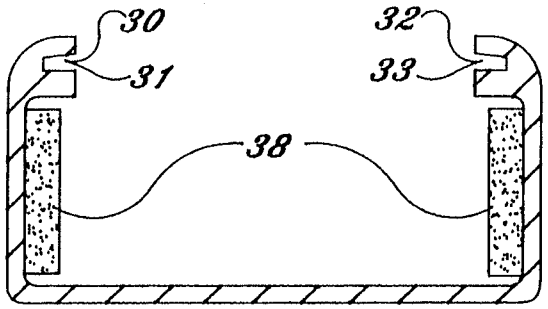
FIG. 4 is a fragmentary view along arrow K of the interior of the protective container shown in FIG. 3.
Figure 5:
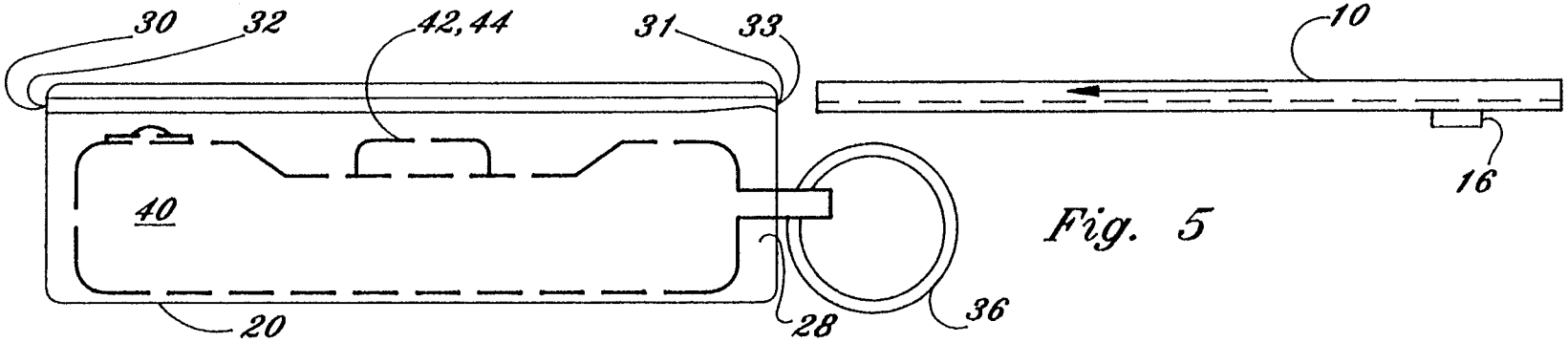
FIG. 5 is a side view along arrow R of the container in FIG. 3 with the cover-panel in position to be slid thereon.
Figure 6:
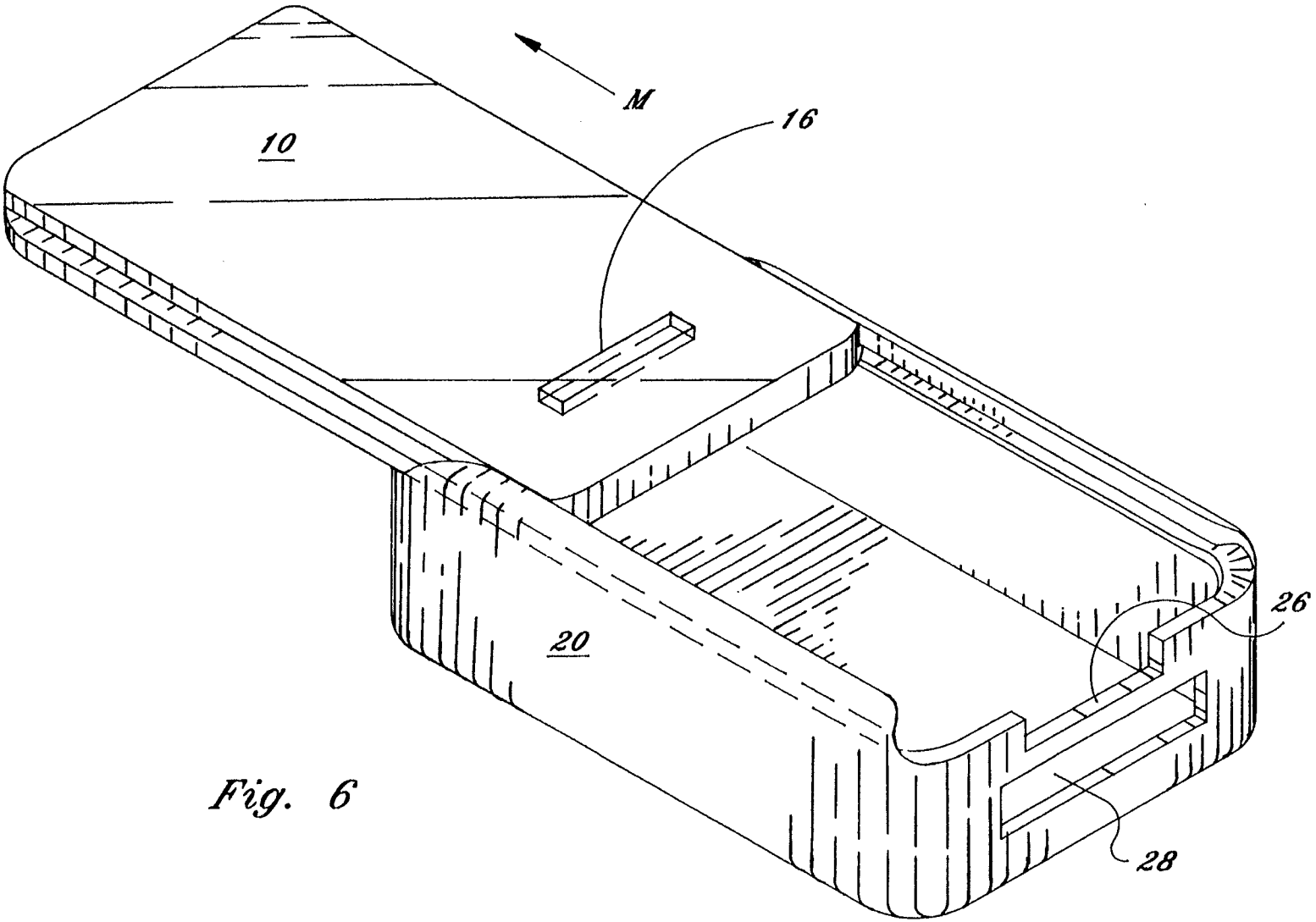

FIG. 4 is a fragmentary view along; arrow K of the interior of the protective container shown in FIG. 3 showing grooves 30 and 32. FIG. 5 is a side view along arrow R of the container 20 in FIG. 3 with the cover-panel 10 in position to be slid thereon. FIG. 6 is a perspective view of the invention showing slidable cover-panel 10 on container 20 in an open position with a remote transmitter 40 within the container 20.

A preferred embodiment for using the protective case to activate an automobile alarm will now be discussed. During assembly, the remote transmitter 40, for activating a car alarm, is placed in first opening 24 of container 20 depicted in FIG. 3. The key chain 36 on the transmitter 40 is positioned to pass through second opening 28, and the control button(s) 42, 44 face upward as depicted in FIG. 5. If necessary, the transmitter 40 is packed with foam inserts 38 shown in FIG. 4 within the container 20 for a snug fit. Next cover-panel 10 is slid by side edges 12, 14 through grooves 31,33 with the catch means 16 facing downward as depicted in FIG. 5. Cover-panel 10 is oriented so that catch means 16 passes through indentation notch 26. In the closed position, cover-panel 10 completely covers first opening 24 as depicted in FIG. 1.

The protective case is operated by using the thumb of one hand to push and slide cover-panel 10 forward enough in the direction of arrow M to expose the control-buttons or switches 42, 44 as depicted in FIG. 6. The cover-panel 10 is prevented from sliding off the container 20 in this direction by the catch means 16. After the button(s) 42, 44 is(are) activated, the cover-panel 10 is slid back into a closed position with the same thumb again forming the arrangement depicted in FIG. 1. Closing the cover-panel prevents an accidental push which would have the effect of disarming the alarm. The tapered groove areas 31, 33 are there to better hold the cover-panel 10 in place when the cover-panel 10 is in a closed position. However, with some extra effort the cover-panel 1() can slide off the container 20 and pass catch means 16 through indentured notch 26 by merely reversing the steps for assembling the protective case.

The case enables one on leaving and approaching their car to use their free hand for carrying items and still safely arm or disarm the alarm with the other hand.

The invention by its design provides several beneficial features. First, it is non-flexible and completely covers and protects the control-buttons or switches on the remote transmitter from being accidentally activated. Two, the protective case has a sliding cover with a catch on its lower side which prevents the cover-panel from being pushed too far forward to come off the container in one direction. Three, the container has grooves on two sides that are tapered at the rear ends to hold the cover-panel in place when the cover-panel is in the closed position. Fourth, the tapered grooves permit the cover-panel to slide off the container in the backward direction with extra effort by allowing the catch to pass through the indentation notch when the cover-panel is moved backward. Fifth, the clear cover-panel allows the user to see the positions of the control-buttons and/or switches.

Although the preferred embodiment describes using a remote transmitter with at least one control button for activating an auto alarm, the protective case would have beneficial application for protecting remote transmitters which control personal alarms, garage door openers, gate openers, automobile trunk releases and household electronics such as a television.

Further, slight differences in the sizes and structures of various makes of remote control transmitters will be accommodated through adjustments made to the protective case such as changing the size and shape of the first and second openings or in using foam inserts as discussed previously Based on the above disclosure, various modifications and alternative embodiments will be apparent. Accordingly, the invention is only to be limited by the claims which follow this disclosure.

I claim:

1. A case protecting the buttons of and supporting a remote control transmitter, the transmitter including an opening for receiving a key chain ring, the case comprising:

a container with a first opening receiving the transmitter;

a rigid, clear plastic cover-panel that slides through two side grooves of the container and across the first opening of the container;

a second opening along one end side wall of the container which is substantially perpendicular to the first opening; and the transmitter key chain ring opening is positioned through the second opening and connectable to a key chain ring.

2. The case according to claim 1 wherein the cover-panel provides protection for at least one control-button or switch on the transmitter.

3. The case according to claim 2, wherein the remote control transmitter activates at least one of an auto alarm and a personal alarm.

4. The case according to claim 2, wherein the remote control transmitter opens and closes at least one of a garage door, a gate and a trunk.

5. The case according to claim 2, wherein the remote control transmitter remotely operates an electronic device.

6. The case according to claim 1, wherein the cover-panel is formed from a rigid, clear plastic.

7. The case according to claim 1, wherein the container further includes beveled edges.

8. The case according to claim 1, wherein the container further includes foam inserts for supporting the transmitter.

9. The case according to claim 1, wherein the container is formed from plastic.

10. The case according to claim 1, wherein the container is formed from metal.

11. A case protecting the buttons of and supporting a remote control transmitter, the transmitter including an opening for receiving a key chain ring, the case comprising:

a container with a first opening receiving the transmitter;

a rigid cover-panel formed from a clear plastic that slides across the first opening of the container, where it protects the buttons of the transmitter that include at least one control-button or switch facing the first opening;

grooves within the top inner walls of the container that hold the cover-panel wherein each groove width tapers starting near one rearward open end of each groove, to cause the cover-panel to tightly fit in place when completely covering the first opening;

a catch positioned on the lower side of the cover-panel that stops the cover-panel from sliding completely off the container in, a forward direction;

an indentation in an end side wall of the container that allows the catch to pass therethrough when sliding the cover-panel completely off in a rearward direction to allow insertion of the transmitter;

a second opening along one end side wall of the container which is substantially perpendicular to the first opening; and the transmitter key chain ring opening is positioned through the second opening and connectable to a key chain ring.

12. The case according to claim 11, wherein the remote control transmitter activates at least one of an auto alarm and a personal alarm.

13. The case according to claim 11, wherein the remote control transmitter opens and closes at least one of a garage door, a gate and a trunk.

14. The case according to claim 11, wherein the remote control transmitter remotely operates an electronic device.

15. A case protecting the buttons of and supporting a remote control transmitter, comprising:

a container with a first opening receiving the transmitter, the container containing two side grooves; and a rigid, clear plastic cover-panel supported within the grooves that slides through the grooves and across the first opening, wherein each groove has a width which tapers starting near a rearward open end of each groove.

16. The case according to claim 15, wherein the cover-panel further includes:

a catch projecting from one side of the cover-panel that stops the cover-panel from sliding completely off the container in a forward first direction.

17. The case according to claim 16, wherein the container further includes:

an indentation in an end side wall of the container that allows the catch to pass therethrough when sliding the cover-panel completely off in a rearward direction to allow insertion of the transmitter.

* * * * *

UNITED STATES PATENT AND TRADEMARK OFFICE

CERTIFICATE OF CORRECTION

PATENT NO. : 5,388,691

DATED : February 14, 1995

INVENTOR(S) : Nona J. White

It is certified that error appears in the above-indentified patent and that said Letters Patent is hereby corrected as shown below:

The title page, showing an illustrative figure, should be deleted and substitute therefor the attached title page.

Col. 1, line 14, change ((to made)) to (to be made).
Col. 1, line 35, change ((era remote)) to (of a remote).
Col. 2, line 3, change ((inserts liar filling space)) to (inserts for filling space).
Col. 2, line 59, change ((romped frown)) to (formed from).
Col. 2, line 34, delete ((with a remote transmitter within the container)) and place a period after the word"position".
Col. 3, line 14, 15, delete ((with a remote transmitter 40 within the container 20)) and place a period after the word "position".
Col. 3, line 36, delete ((as depicted in Fig. 6)) and place a period after the number "44".

Signed and Sealed this

Twenty-third Day of May, 1995

*Attest:*

Bruce Lehman

BRUCE LEHMAN

*Attesting Officer*

*Commissioner of Patents and Trademarks*

United States Patent [19]

White

[11] Patent Number: 5,388,691

[45] Date of Patent: Feb. 14, 1995

[54] PROTECTIVE CASE FOR REMOTE CONTROL TRANSMITTER

[76] Inventor: Nona J. White, 1141 NW. 84th Ter., Pembroke Pines, Fla. 33024

[21] Appl. No.: 139,567

[22] Filed: Oct. 21, 1993

[51] Int. Cl.[6] ..... B65D 85/38; A45C 11/32; G08C 19/00

[52] U.S. Cl. ..... 206/305; 70/456 R; 206/37; 206/38; 220/242; 220/346; 220/351; 340/825.69; 340/825.71

[58] Field of Search ..... 206/305, 320, 38, 37, 206/38.1, 39, 37.1; 150/165; 220/241, 242, 345, 346, 350, 351; 340/825.31, 825.32, 825.34, 825.69; 70/456 R

[56] References Cited

U.S. PATENT DOCUMENTS

| | | | |
|---|---|---|---|
| D. 315,112 | 3/1991 | Andrew et al. . | |
| 3,021,142 | 2/1962 | Carroll . | |
| 3,127,653 | 4/1964 | Budreck | 335/285 |
| 3,362,564 | 1/1968 | Mueller | 220/346 |
| 3,406,821 | 10/1968 | Weissberg | 220/345 X |
| 3,527,373 | 9/1970 | Giraudet et al. | 220/345 |
| 3,632,848 | 1/1972 | Young et al. . | |
| 3,819,921 | 6/1974 | Kilby et al. . | |
| 4,116,706 | 9/1978 | Previte . | |
| 4,165,554 | 8/1979 | Faget | 206/305 X |
| 4,208,720 | 6/1980 | Harrison . | |
| 4,231,626 | 11/1980 | Ammann et al. . | |
| 4,259,568 | 3/1981 | Dynesen . | |
| 4,281,527 | 8/1981 | Leopoldi et al. | 70/456 R |
| 4,348,723 | 9/1982 | Woods et al. . | |
| 4,402,423 | 9/1983 | Skowronski et al. | 220/345 |
| 4,412,356 | 10/1983 | Klaus et al. | 340/825.71 X |
| 4,420,078 | 12/1983 | Belt et al. . | |
| 4,478,330 | 10/1984 | Lin . | |
| 4,713,951 | 12/1987 | Ros | 70/456 R |
| 4,733,776 | 3/1988 | Ward | 206/305 |
| 4,836,256 | 6/1989 | Meliconi | 206/305 X |
| 4,890,108 | 12/1989 | Drori et al. | 340/825.69 X |
| 4,951,817 | 8/1990 | Barletta et al. . | |
| 5,220,319 | 6/1993 | Kendel | 340/825.69 |
| 5,263,577 | 11/1993 | Paratte et al. | 206/38.1 |
| 5,265,720 | 11/1993 | Meliconi | 206/305 |
| 5,278,556 | 1/1994 | Oh | 340/825.69 X |

OTHER PUBLICATIONS

Motorola Technical Developments "Pager and Garage Door Opener Combination" Mar. 1990.

The Clifford DeltaIII TM an advanced technology remote control vehicle security system.

*Primary Examiner*—Bryon P. Gehman

[57] ABSTRACT

A case protecting the buttons of and supporting a remote control transmitter, the transmitter including an opening to receive a key chain ring, the case further including a container and a rigid clear plastic cover-panel that is slidable by one's thumb. The cover-panel is fitted within two side grooves tapered only at rear ends in the container and also includes a catch that prevents the cover-panel from sliding completely off the container in a forward direction. The container includes an indentation notch on one side end wall that allows the catch to pass therethrough when sliding the cover-panel completely off the container in the rearward direction. There is also provided a second opening in the container that permits the transmitter's key chain ring opening to pass therethrough. The case protects the buttons of the transmitter. The transmitter can be one that activates personal or auto alarms, opens and closes garage doors or gates, unlocks an automobile trunk, or controls household electronics.

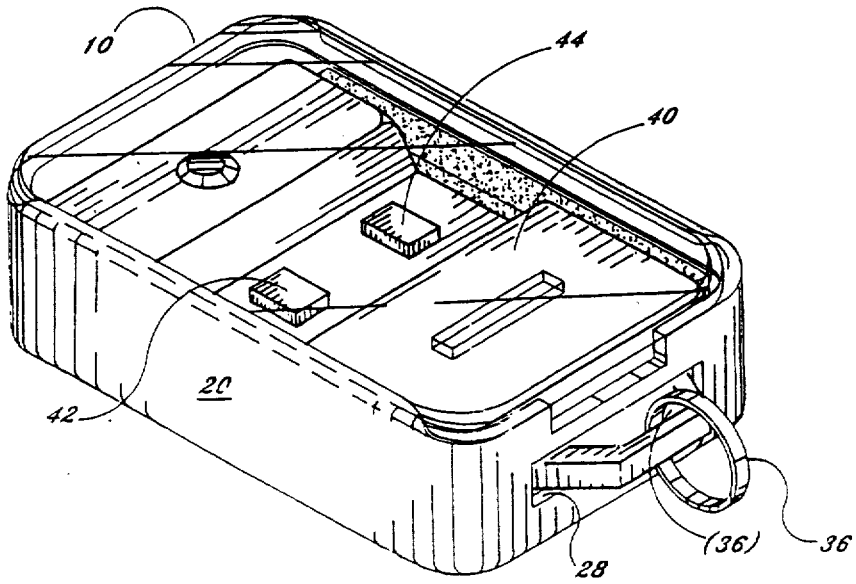

17 Claims, 4 Drawing Sheets